United States Patent [19]

Otterpohl

[11] 4,232,653

[45] Nov. 11, 1980

[54] WOOD-BURNING FURNACE

[76] Inventor: James H. Otterpohl, Rte. 3 Box 35B, Clinton, Ark. 72031

[21] Appl. No.: 18,645

[22] Filed: Mar. 8, 1979

[51] Int. Cl.[3] ..... F24C 1/14

[52] U.S. Cl. ..... 126/77; 126/15 A; 126/112; 126/121; 110/312

[58] Field of Search ..... 126/77, 15, 112, 146, 126/163 R, 121; 110/251, 265, 310, 312; 237/51

[56] References Cited

U.S. PATENT DOCUMENTS

| | | | |
|---|---|---|---|
| 2,164,262 | 6/1939 | Wagner | 110/312 |
| 4,111,181 | 9/1978 | Canney | 126/77 |
| 4,174,701 | 11/1979 | Gheiting | 237/51 |
| 4,180,051 | 12/1979 | Maier et al. | 126/77 |

*Primary Examiner*—George T. Hall

*Attorney, Agent, or Firm*—John A. Hamilton

[57] ABSTRACT

A wood-burning furnace including a combustion chamber having a novel combustion air distribution system including jets whereby air is delivered only to a limited portion of the area of the fire bed, and whereby clogging of the jets by the large quantities of wood ash is prevented, the combustion air being delivered by a thermostatically controlled blower and damper system such that the heat delivered by the furnace may be controlled and regulated with substantially the same degree of accuracy as that obtainable with gaseous and liquid fuels.

9 Claims, 5 Drawing Figures

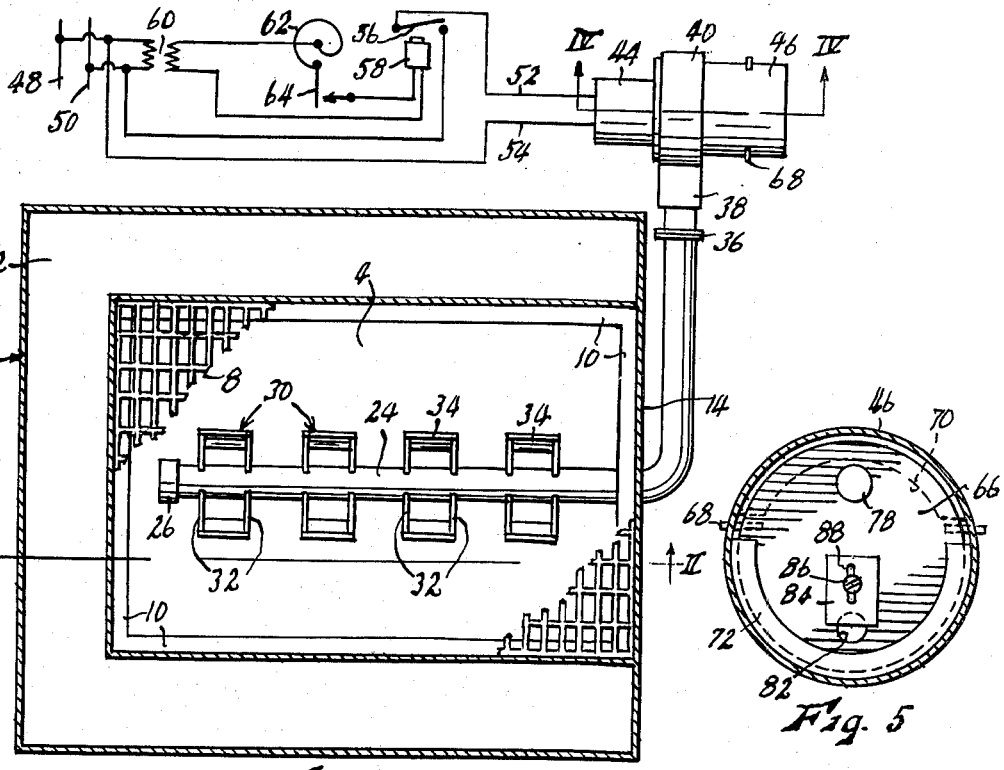
Fig. 1
Fig. 5
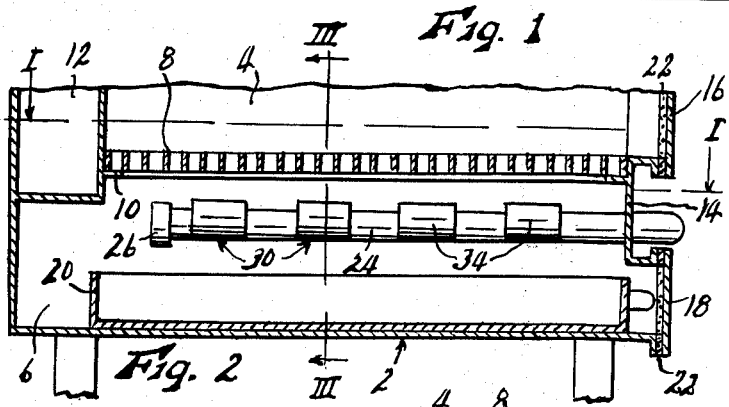
Fig. 2
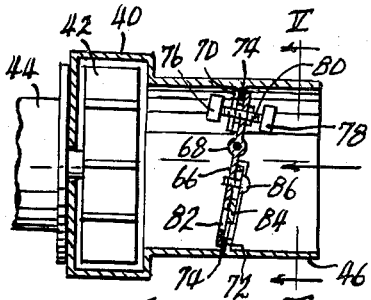
Fig. 4
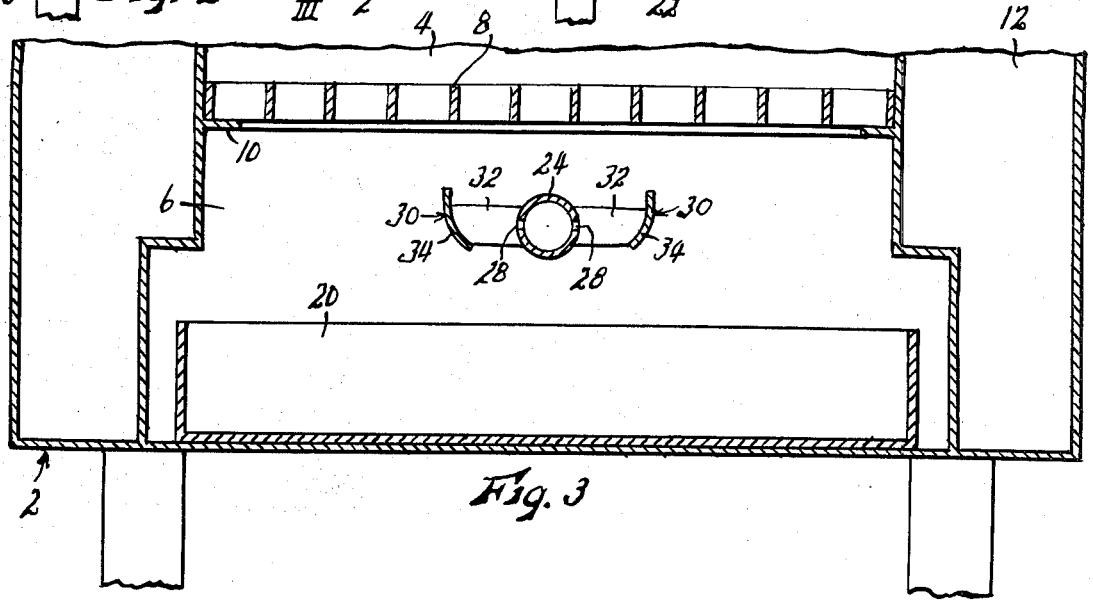
Fig. 3

WOOD-BURNING FURNACE

This invention relates to new and useful improvements in furnaces, and has particular reference to furnaces especially adapted for the burning of wood as a fuel.

Wood-burning stoves and furnaces have in recent years been enjoying a resurgence of popularity, no doubt aided by the energy crisis and the decreasing availability of more common fuels such as gas and oil. However, wood burning devices have heretofore been commonly subject to certain shortcomings and disadvantages, principal among which have been that a fire bed of wood, once ignited, of course tends to continue to burn until it is consumed, regardless of whether the zone being heated actually requires or needs the heat at any given time, and the well known property of wood fires in producing large quantities of ash which can clog and obstruct the passage of air through the fire bed when combustion is desired, and the flow of air to the fire bed itself, whenever relatively restricted and controlled air passages are used to provide this air supply flow.

Accordingly, a primary object of the present invention is the provision of a wood-burning furnace in which the air for combustion is thermostatically controlled, rather than the fuel supply as is customary when using gaseous or liquid fuels, in such a manner that active combustion of the wood is permitted when a thermostat in the comfort zone being heated calls for heat, but which causes the fire to be nearly, but not completely, snuffed out when the thermostat is not calling for heat, admitting only enough air to maintain combustion at only a minimum rate insufficient to supply the minimum heat requirement of the heated zone. In this manner, the fire may in effect be "turned on" when heat is required, and "turned off" when heat is not required. A quantity of wood stoked into the furnace is thus effectively being burned only when heat is called for by the thermostat. Generally, this object is accomplished by substantially sealing the combustion chamber against the entry of air except for a single air conduit, providing a thermostatically controlled blower in said conduit, providing a damper operable to close the conduit when the blower is not operating, and modifying the damper to pass a regulatable minimum quantity of air even when said damper is closed.

Another object is the provision of a wood-burning furnace of the character described having means whereby air supplied by the blower is directed primarily to a restricted area of the fire bed. This further defeats the tendency of the wood once ignited, to burn until consumed, in that the wood is thus caused to tend to burn initially only in the restricted area of the bed to which air is delivered, and the flames to proceed more slowly, of necessity, to the more remote areas of the fire bed.

A further object is the provision of a wood-burning furnace of the character described having novel means whereby the combustion air is delivered upwardly by jets through a fire bed supported on a grate, but such that ashes falling through the grate cannot clog or obstruct the air jets. Generally, this object is accomplished by directing the jets horizontally rather than upwardly, but against spaced apart, "bottomless" deflectors operable to deflect the ejected air upwardly.

Other objects are simplicity and economy of construction, and efficiency and dependability of operation.

With these objects in view, as well as other objects which will appear in the course of the specification, reference will be had to the accompanying drawing, wherein:

FIG. 1 is a partially schematic horizontal sectional view of a wood-burning furnace embodying the present invention, taken on line I—I of FIG. 2, with parts broken away, FIG. 2 is a fragmentary sectional view taken on line II—II of FIG. 1, FIG. 3 is an enlarged, fragmentary sectional view taken on line III—III of FIG. 2, FIG. 4 is an enlarged, fragmentary sectional view taken on line IV—IV of FIG. 1, and FIG. 5 is an enlarged sectional view taken on line V—V of FIG. 4.

Like reference numerals apply to similar parts throughout the several views, and the numeral 2 applies generally to a wood-burning furnace embodying the present invention. It includes a body having walls forming a combustion chamber 4, the upper portion of which is provided with a flue or chimney connection not shown, an ash pit 6 beneath said combustion chamber and divided therefrom by a horizontal, open-work grate 8 supported on ledges 10, and an air plenum chamber 12 surrounding generally the sides, rear and top of the combustion chamber, but not the front, having a front wall 14 in which is provided on upper door 16 (see FIG. 2) which when opened provides access for inserting wood logs or the like into combustion chamber 4 to be supported on grate 8, and a lower door 18 which when opened permits the removal of an ash tray 20 disposed in ash pit 6 for receiving ashes falling through grate 8. Doors 16 and 18 may be opened in any suitable manner, as by hingeing (not shown), and for reasons to be described hereinbelow each door is provided with a gasket 22 such that when the doors are closed, they are substantially sealed against the passage of air thereround to the interior of the furnace. Grate 8 is preferably formed in sections, which can be removed from the furnace for cleaning through door 16, but this is not pertinent to the present invention.

Air for combustion is delivered by a horizontal pipe 24 sealed in front wall 14, and extending rearwardly along the midline of the furnace, just below grate 8, and being capped as at 26 at its rearward end. Along each side of the portion of pipe 24 within the furnace there are formed a series of longitudinally spaced apart orifices 28 (see FIG. 3), each adapted to direct a jet of air horizontally outwardly when air is delivered to said pipe by a blower to be described. The number and size of said orifices is a design consideration, depending primarily on the volume of the combustion chamber, and the air delivery capacity of the blower. Said orifices are generally evenly spaced along the front-to-rear depth of the furnace. In connection with each orifice there is provided on air deflection assembly 30 consisting of a pair of side bars 32 fixed to and extending horizontally outwardly from pipe 24, respectively at opposite sides of the orifice, and a deflector plate 34 affixed to and extending between the outer ends of said side bars. Said deflector plate is elongated in a direction parallel to pipe 24, but is curved outwardly and then upwardly from its lower edge, as best shown in FIG. 3, whereby to deflect the horizontal jet of air emerging from the associated orifice 28 upwardly toward and through grate 8. It will be noted than the total transverse span of the air deflectors 34 of pipe 24 amounts to only about one-third of the transverse width of grate 8, and to the central one-third of the width of the grate. While this proportion is not critical, it has an important function to be more fully described hereinbelow. The horizontal and generally rectangular space defined by side bars 32, deflector plate 34 and pipe 24 is vertically open, so that ashes sifting downwardly through the grate may fall freely therethrough to ash tray 20.

Externally of the furnace, pipe 24 is connected by means of a flanged coupling 36 to the delivery conduit 38 of a blower housing 40 in which a blower fan 42 driven by an electric motor 44 is operably mounted. Blower housing 40 is also equipped with an air intake conduit 46 for receiving atmospheric air for delivery to pipe 24. Blower motor 44 is powered from electric line wires 48 and 50 through a circuit including wires 52 and 54, in which is interposed a normally open relay switch 56. The coil 58 of said relay switch is controlled by a circuit from line wires 48 and 50, a transformer 60 for reducing the voltage, and a thermostat 62 including a normally open switch 64 which is closed by the thermostat, whereby to close relay 56 and actuate blower motor 44, whenever said thermostat calls for heat. The thermostat is of course disposed within the comfort zone to be heated by the furnace. This control system is of course standard within itself. It will be understood that air from the comfort zone is drawn from the zone to be heated, circulated through plenum chamber 12 to be warmed by heat conducted through the walls of the combustion chamber, and returned to the zone being heated. This circulation may be accomplished by gravity flow of the air, or by means of a separate blower if a forced draft is desired. Both of these options are considered to be within the scope of the present invention. If a blower is used to provide a forced circulation draft, the motor driving that blower would ordinarily be controlled by a thermostatic switch disposed in the stack of combustion chamber 4, so as to prevent plenum circulation until the combustion chamber and stack rises to a pre-determined minimum temperature even after operation of blower 40 has re-established the combustion chamber fire, and to maintain the plenum circulation even after the cessation of operation of blower 40 has signalled the snuffing of the fire until the stack has fallen to a pre-determined low temperature. However, said automatic stack switch controls are common and well known in the furnace art, and are not considered directly pertinent to the present invention.

Disposed in air intake conduit 46 of blower 40, said conduit being circular in cross-section, is a damper 66 constituting a circular disc pivoted in said conduit on an axis disposed in its own plane and vertically above the center thereof, as at 68. FIG. 4 shows the damper closed, to which position it moves by gravity whenever blower 40 is deactivated. In this position it substantially closes and seals conduit 46 against the passage of air therethrough, the edges thereof above and below pivot 68 respectively engaging inner and outer annular flanges 70 and 72 provided therefor in the conduit. Each of said flanges is provided with a gasket 74 (see FIG. 4) to improve the efficiency of the seal. The damper is opened, swinging in a clockwise direction as viewed in FIG. 4 under the pressure against its outer surface generated by the operation of blower 40. A given blower should open the damper sufficiently to supply air at a rate ample to support full combustion of the wood in combustion chamber 4. A pair of counterweights 76 and 78, carried at the opposite ends of a screw 80 threaded normally in the damper above its pivot, may be adjusted by turning said screw to adjust the pressure required to open said damper to the intake suction supplied by any given blower. The damper disc is also provided with an opening 82, below the pivotal axis thereof. Opening 82 is partically covered by a plate 84 secured to the damper disc by a screw 86 extending through a slot 88 of the plate and threaded into the disc, whereby the degree to which said plate covers opening 82 may be closely adjusted. Opening 82 and plate 84 of course amount to a supplemental damper operable to admit a small quantity of air through blower 40 and thence to the combustion chamber, even when main damper 66 is closed.

In operation, logs or other forms of wood are first inserted in combustion chamber 4 after door 16 has been opened, the wood initially ignited by any suitable means, not shown, and the door closed. Provided that ash door 18 is also closed, and both doors sealed by gaskets 22, then the only avenue by which air can enter the combustion chamber to support further combustion of the wood is through air pipe 24. Whenever thermostat 62 calls for heat in the comfort zone, it actuates blower motor 44 to drive blower 40, drawing atmospheric air inwardly through conduit 46 to open damper 66, and delivering said air through pipe 24 to the combustion chamber. The blower and air pipe are of course selected to have sufficient capacity to deliver a quantity of air fully adequate to support normal combustion in chamber 4, when damper 66 is open.

As previously described, air jet openings 28 and deflector plates 34 are arranged to direct air upwardly primarily through only a restricted portion of the area of grate 8, in this case approximately the central one-third of said area, considered laterally thereof. This restriction tends to defeat the tendency of the flame in a wood fire bed to spread rapidly over the entire area of the bed, by concentrating the air delivery primarily in the restricted area, so that flames initially occur primarily in the central restricted area, then spreads more slowly to the more remote areas of the bed due to the more restricted supply of air thereto. This provision tends to reduce the wastage of the heat content of the wood brought about by rapid combution of the entire area of the bed, which tends to release heat more rapidly than it can be utilized to heat the comfort zone, so that it is wasted to the atmosphere up the flue or chimney. This permits a more efficient and economical use of the heat content of the wood by providing for a more gradual release thereof, which may be more effectively controlled.

The combustion of wood produces large quantities of ash, the control and disposition of which can be a problem. Such ash could for example clog the fire bed itself against the free passage of air therethrough, and thus tend to smother the combustion, at least in portions of the area of the bed. The open-work nature of grate 8 permits the ash to fall freely therethrough, so as to prevent such clogging of the fire bed. Also, the ash, having fallen through the grate, could readily enter and eventually clog air jet orifices 28, or any upwardly directed air passages, if special means are not provided for preventing it. In the present case, such special means include the horizontal disposition of said orifices, so that falling ash will not enter thereinto and the disposition of deflector plates 34, which divert the horizontal air jets upwardly toward the grate, in spaced apart relation from the orifices, so that falling ash may fall freely therebetween to ash tray 20, which may be easily removed from the furnace through door 18 for disposal of the ash. Whenever thermostat 62 signals that the heat demand of the comfort zone has been satisfied, this deactuates blower motor 44, and allows damper 66 to close by gravity, which closure greatly reduces the air supply to the combustion chamber to partially dampen or "snuff out" the fire. The damper is necessary since in its absence, full combustion could be maintained, even with blower 40 deactuated, by air drawer through the blower by the natural stack draft created by the heat of the fire. However, if said damper when closed completely sealed air conduit 46 against the passage of air therethrough, and provided that both of doors 16 and 18 are closed and sealed by gaskets 22, the fire would immediately be completely snuffed out for lack of oxygen, since these are the only avenues by which air can enter the combustion chamber. These avenues must be nearly closed, since otherwise substantial combustion of the wood would continue even after thermostat 62 was no longer calling for heat, but on the other hand a certain minimum residual degree of combustion must be allowed to continue to permit re-establishment of full combustion when the thermostat again calls for heat. The degree of such residual combustion should be slight, preferably releasing an amount of heat less than even the minimum requirements of the comfort zone, but it must be present. Otherwise the described thermostatic control would not be possible. Supplemental damper 82–84 admits the air necessary to support the residual combustion, even when blower 40 is not operating, the air being impelled through opening 82 by the natural stack draft generated by the heat of the fire bed. Adjustment of the rate of the supplemental air supply may be obtained by loosening screw 86 and moving plate 84 to cover variable proportions of opening 82, and may be necessary, for example, to adjust the supplemental air supply rate to the type and moisture content of the wood being used. Of course, the mounting of the supplemental damper directly in the disc of main damper 66 is optional. Said dampers may be separate, and both may be disposed at any suitable points in the air flow between the furnace and the intake of blower 40, so long of course as the supplemental damper is disposed "downstream" from the main damper.

While I have shown and described a specific embodiment of my invention, it will be readily apparent that many minor changes of structure and operation could be made without departing from the spirit of the invention.

What I claim as new and desire to protect by Letters Patent is:

1. A wood-burning furnace comprising:

a. a furnace body providing a combustion chamber for receiving wood to be burned, b. an open-work grate forming the floor of said combustion chamber for supporting said wood, c. an ash pit disposed beneath said combustion chamber and communicating therewith through said grate, d. air supply means operable to supply combustion air to said ash pit, beneath said grate, said combustion chamber and ash pit being otherwise sealed against the entry of air, and e. thermostatically actuated control means, responsive to the air temperature in a comfort zone to be heated by said furnace, to regulate said air supply means to supply air at a rate sufficient to support full combustion of said wood when said control means calls for heat, and to regulate said air supply means to supply air at a rate sufficient only to maintain combustion of said wood at a minimum rate when said control means does not call for heat.

2. A furnace as recited in claim 1 wherein said air supply means is operable to direct air upwardly toward said grate primarily only over a restricted portion of the total horizontal area of said grate.

3. A furnace as recited in claim 1 wherein said air delivery means is operable to inject air into said ash pit beneath said grate, as horizontally directed jets, and with the addition of deflector members operable to divert said horizontal air jets upwardly toward said grate.

4. A furnace as recited in claim 1 wherein said air delivery means comprises:

a. a pipe operable to conduct air into said ash pit, beneath said grate and in the upper portion of said ash pit, said pipe having orifices formed therein operable to direct jets of air horizontally outwardly from said pipe, and b. a deflector plate disposed in horizontally outwardly spaced relation from each of said pipe orifices, and curved to divert the air jet emerging from said orifice upwardly toward said grate, the space between each of said pipe orifices and its associated deflector plate being vertically open whereby ashes passing through said grate may fall freely therethrough to the lower portion of said ash pit.

5. A furnace as recited in claim 4 wherein said deflector plates are arranged to divert said air jets upwardly toward said grate primarily only over a restricted portion of the total horizontal area of said grate.

6. A furnace as recited in claim 1 wherein said control means comprises:

a. a conduit interconnecting said air supply means to the exterior atmosphere, b. a blower disposed in said conduit and operable when actuated to impel air through said conduit, and c. thermostatic means responsive to the air temperature in a comfort zone to be heated by said furnace to actuate said blower when said thermostatic means calls for heat, and to deactuate said blower whenever said thermostatic means does not call for heat.

7. A furnace as recited in claim 6 with the addition of damper means disposed in said conduit, and being operable automatically to open, whenever said blower is actuated, to pass air at a rate sufficient to support full combustion of the wood in said combustion chamber, and to close, whenever said blower is deactuated, to pass air at a rate sufficient only to support combustion of said wood at a minimum rate.

8. A furnace as recited in claim 7 wherein said damper means comprises:

a. a main damper operable to open, and close substantially completely, automatically in response to actuation and deactuation of said blower, and b. a continuously open supplemental damper, of sufficient air capacity only to support minimum combustion of the wood when said blower is not actuated, and operable to admit air to the conduit downstream from said main damper.

9. A furnace as recited in claim 8 with the addition of means operable to adjust the air flow capacity of said supplemental damper.

* * * * *